US006017412A

United States Patent [19]

Van Erden et al.

[11] Patent Number: 6,017,412

[45] Date of Patent: Jan. 25, 2000

[54] METHOD FOR ATTACHING RECLOSABLE ZIPPER STRIP TRANSVERSELY TO THERMOPLASTIC FILM MATERIAL

[75] Inventors: Donald L. Van Erden, Wildwood; Art Malin, Northbrook; Michael J. McMahon, Palatine; Lawrence Share, Skokie, all of Ill.

[73] Assignee: Illinois Tool Works Inc., Glenview, Ill.

[21] Appl. No.: 09/110,663

[22] Filed: Jul. 6, 1998

[51] Int. Cl.[7] ..... B65B 43/04; B65B 51/10

[52] U.S. Cl. ..... 156/290; 156/66; 156/308.4; 53/133.4; 53/139.2; 493/213

[58] Field of Search ..... 156/292, 66, 290, 156/308.4, 275.1; 53/133.4, 139.2; 493/213

[56] References Cited

U.S. PATENT DOCUMENTS

| | | | |
|---|---|---|---|
| 4,240,241 | 12/1980 | Sanborn, Jr. | 53/412 |
| 4,817,188 | 3/1989 | Van Erden | 383/63 |
| 4,844,759 | 7/1989 | Boeckmann | 156/66 |
| 4,909,017 | 3/1990 | McMahon et al. | 53/410 |
| 5,557,907 | 9/1996 | Malin et al. | 53/139.2 |
| 5,564,259 | 10/1996 | Stolmeier | 53/410 |
| 5,816,018 | 10/1998 | Bois | 53/133.4 |

*Primary Examiner*—Francis J. Lorin

*Attorney, Agent, or Firm*—Kane, Dalsimer Sullivan and Levy, LLP

[57] ABSTRACT

A method for attaching reclosable zipper strips transversely to thermoplastic film material which may be used to make reclosable bags or packages in a form-fill-seal machine is claimed. The zipper strip includes a male profile and a female profile. The male profile includes a male interlocking member and an integral web comprising a trailing flange and, optionally, a leading flange. Likewise, the female profile includes a female interlocking member and an integral web comprising a trailing flange and, optionally, a leading flange. As the film material is advanced into the form-fill-seal machine in bag length increments, the interlocked zipper strip is disposed on the film material transversely thereto with the trailing flange oriented in a direction opposite to the motion of the film material. The zipper strip is then sealed to the film material at its extremities. In this manner the male and female profiles are sealed to each other and to the film material. The sealing may be continuous or may take the form of spot seals.

9 Claims, 6 Drawing Sheets

METHOD FOR ATTACHING RECLOSABLE ZIPPER STRIP TRANSVERSELY TO THERMOPLASTIC FILM MATERIAL

BACKGROUND OF THE INVENTION

1. Field of the Invention

The present invention relates to reclosable plastic bags of the type in which food products, such as chips and cereal, and other goods are packaged for sale to consumers. More particularly, the present invention relates to reclosable plastic bags manufactured and filled on form-fill-seal (FFS) machines, wherein a series of interlocked plastic zipper strips are attached at bag-length intervals transversely to the longitudinal axis of the thermoplastic film material used to form the reclosable bags on the FFS machine.

2. Description of the Prior Art

The present invention relates to improvements in the package-making art and may be practiced in the manufacture of thermoplastic bags and packages of the kind that may be used for various consumer products, but which are particularly useful for food products which must be kept in moisture and air-tight packages, free from leakage until initially opened for access to the product contents, which packages are then reclosable by zipper means to protect any remainder of the product therein. The prior art is fairly well-developed, but nevertheless remains susceptible to improvement contributing to increased efficiency and cost effectiveness.

One problem that persists with reclosable packages produced from a continuous supply of thermoplastic film material on FFS machines is the difficulty in attaining a satisfactory sealing of the bag or package against leakage, particularly where the zipper and area of film engaged by the zipper extends through the side (cross) seal areas separating one bag or package from the next. This problem occurs where the zipper is attached parallel to the longitudinal axis of the thermoplastic film material used to form the reclosable bags on the FFS machine, in which case the transverse, or side, sealing bars must flatten and seal the zipper at the same time they are sealing the thermoplastic film from which the packages are being made. The difficulty with which this is consistently and successfully achieved is reflected by the high occurrence of leaking packages.

In addition, the length of reclosable packages made on FFS machines wherein the zipper is attached parallel to the longitudinal axis of the thermoplastic film is limited to the diameter of the filling tube of the FFS machine. Thus, generally bags of this type are wider than they are long. While such bags are suitable for certain products where shorter bags are desirable, such as cheese and chicken parts, these bags are not suitable for applications in which longer bags are desirable, for example chips and other snack foods.

Among the approaches taken to solve these problems has been the substitution of a transverse zipper for the longitudinal zipper. A method and apparatus for making reclosable bag material and reclosable bags on a FFS machine utilizing transverse zippers is disclosed in U.S. Pat. No. 4,909,017.

When a transverse zipper is provided, the cross-sealing bars associated with the FFS machine do not flatten the zipper profile during formation of the top and bottom seals of the package since the transverse sealing bars may seal the zipper to the thermoplastic sheet material transversely thereacross without contacting the zipper profile. In addition, when a transverse zipper is used the length of the packages made on the FFS can be varied without varying the length of the transverse zipper segment and is not limited to the diameter of the filling tube.

The present invention relates to a method for attaching a transverse zipper to thermoplastic film material which is used to make reclosable plastic bags or packages on a FFS machine. More specifically, the present invention is a method for securing the zipper strip transversely across the thermoplastic film from which reclosable bags are produced on a FFS machine wherein the zipper strip is sealed to the film at the zipper strip's ends.

When attaching zipper strip to film material for use in transverse zipper applications with a process generally described in U.S. Pat. No. 4,909,017, it is critical that the leading edge of the zipper strip be sealed to the film before it enters the forming area of the FFS machine. If the leading edge of the zipper strip is not sealed to the film, then the zipper strip could become detached when in enters the tube area of the FFS machine. To overcome this problem, a webbed zipper having leading flanges of unequal width is typically used in transverse zipper applications. This disparity in web width makes it possible to seal the zipper strip to the film by sealing only the longer of the leading flanges to the film along its length. If the leading flanges were the same width and traditional sealing methods were used, then the flanges would be sealed to each other as well as the film, thereby sealing the zipper strip closed and making same unusable.

The problem with this current method, however, is that it requires manufacture of a special zipper strip having leading flanges of different widths, which is often difficult and expensive to manufacture. Thus, the object of the present invention is to provide a method wherein a zipper strip having equal leading flanges, or even no leading flanges at all, can be attached to the thermoplastic film material such that the transverse zipper-equipped film can be formed into reclosable bags or packages in the FFS machine.

SUMMARY OF THE INVENTION

Accordingly, the present invention is a method for attaching interlocked zipper strips to a continuous supply of thermoplastic film material wherein the zipper strips are attached transversely to the longitudinal axis of the thermoplastic film material at bag-length intervals and wherein the transverse zipper-equipped material may be made into reclosable bags on a FFS machine.

In accordance with the present invention, the zipper strip comprises a male profile and a female profile for mating with the male profile. The male profile comprises a male interlocking member having a web integral therewith. Likewise, the female profile comprises a female interlocking member having a web integral therewith. The male interlocking member is engageable within the female interlocking member to join the male and female interlocking profiles together. The webs on the male and female profiles are preferably of the same width and project in the same direction which is opposite to the direction of travel of the film material. Additional webs may also project in the direction of travel of the film material.

In operation thermoplastic film material is intermittently paid off a continuous supply of the same. A length of the zipper strip is attached to the flat film material transverse to its longitudinal axis each time the film material advances in bag-length increments. The strip is applied with one of the profiles on top of the other profile and is attached to the thermoplastic film material by sealing the male and female profiles to each other and to the film material at the extremities of the zipper strip. The sealing may take place continuously across the width of the profiles or may take the form of spot seals therealong. The zipper-equipped film may be rolled up and used on a FFS machine at a later time, or may be fed directly into a FFS machine.

In the latter case, the thermoplastic film material with the transverse zipper strips attached at bag length intervals is fed into the FFS machine where it is formed into a bag, filled, and sealed. Specifically, the transverse zipper-equipped thermoplastic film is folded over the collar of the FFS machine and wrapped around the filling tube to form a tube. The longitudinal edges are then sealed to form a back seam. Next, the cross-sealing jaws seal the bottom of the tube to form an open bag. At this point the bag may be filled, and the jaws then seal both trailing flanges to the film across their length so as to make a completed bag.

The present invention will now be described in more complete detail with frequent reference being made to the figures identified below.

DETAILED DESCRIPTION OF THE PREFERRED EMBODIMENTS

Figure 1:
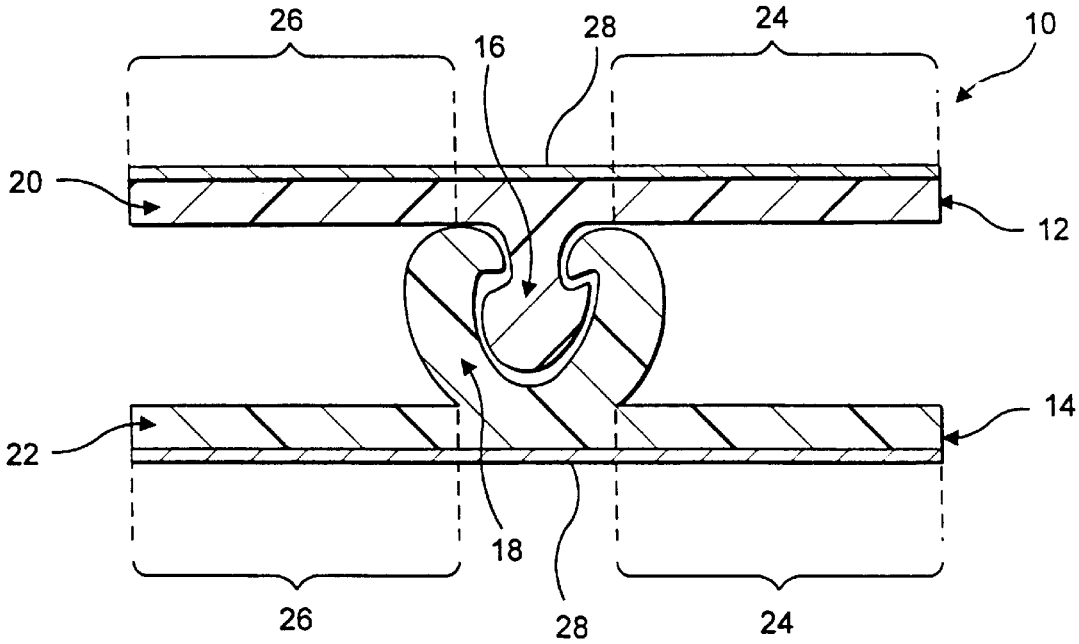
FIG. 1 is a cross sectional view of a zipper strip in accordance with a first embodiment of the present invention.

Referring specifically to the figures identified above, FIG. 1 is a cross-sectional view of a zipper strip 10 in accordance with a first embodiment of the present invention. The zipper strip 10 comprises a male profile 12 and a female profile 14. The male profile 12 has a male interlocking member 16 which may have an arrow-shaped cross-section, or as shown in FIG. 1, an asymmetrical arrow-shaped cross section designed to make the zipper strip 10 easier to open from one side or the other. The female profile 14 includes a female interlocking member 18 comprising two inwardly curving members forming a receptacle or channel into which male interlocking member 16 may be engaged. It should be noted that while these configurations for male and female members 16, 18 are preferred, any configuration which provides for interlocking may be used.

Both the male and female profiles 12, 14 include webs 20, 22 which may be coextruded with male and female interlocking members 16, 18 or extruded separately and attached at a later time. Opposing webs 20, 22 have the same width and each have a leading flange 24 and a trailing flange 26. Leading flange 24 is so called because this is the flange which first enters the FFS machine after the zipper strip 10 is attached to the thermoplastic film material. Ultimately, the leading flange 24 will reside inward of the mouth of the plastic bag or package manufactured on the FFS machine. Webs 20, 22 may be equipped with a heat activated adhesive 28 to aid in the sealing of the zipper strip 10 to the film material.

Figure 2:
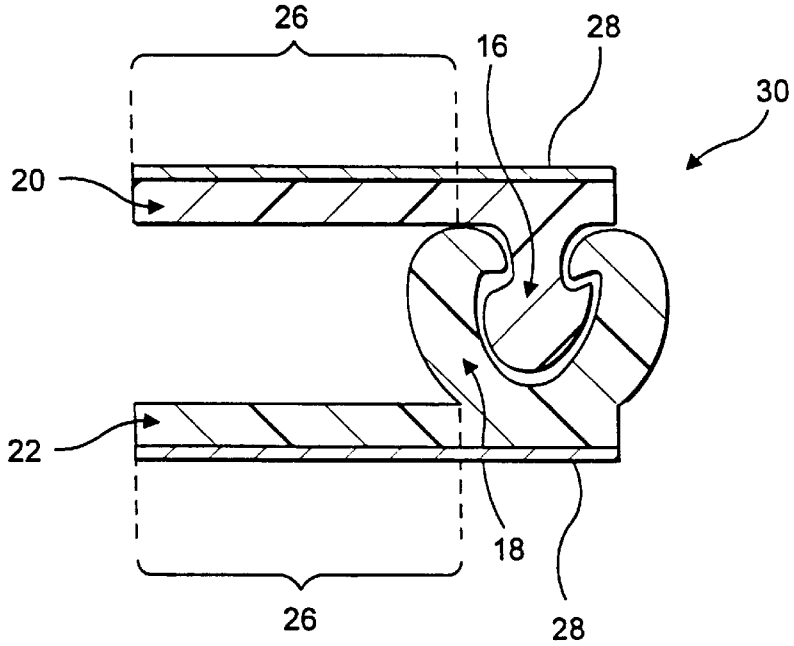
FIG. 2 is a cross sectional view of a zipper strip in accordance with a second embodiment of the present invention.

FIG. 2 is a cross-sectional view of a zipper strip 30 in accordance with a second embodiment of the present invention. Elements in common to both zipper strip 10 and zipper strip 30 are identified in FIG. 2 using the same reference numerals. The zipper strip of FIG. 2 is identical to the zipper strip of FIG. 1 except that the zipper strip of FIG. 2 does not have leading flanges 24. Rather, it only has trailing flanges 26.

Figure 3:
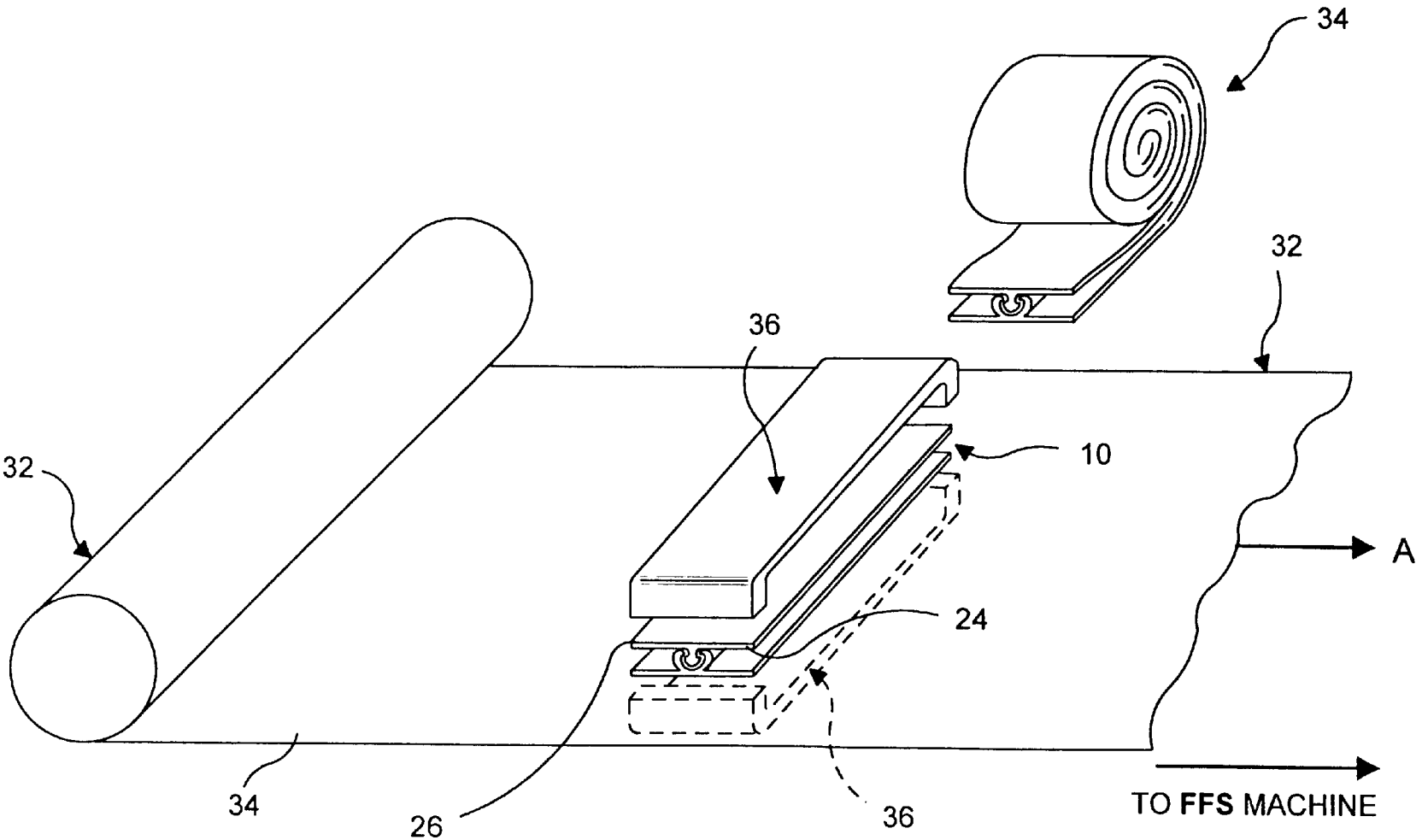
FIG. 3 is a perspective view of a zipper strip being attached to thermoplastic film material in accordance with the present invention.

FIG. 3 depicts how a zipper strip 10, 30 is attached to the film material 32 having a longitudinal axis A in accordance with the present invention. The zipper strip is supplied from a continuous roll 34 and is pulled or pushed across the film material 32 and disposed thereon by a positioning device 74 (not shown in FIG. 3 for clarity). The positioning 74 device can take any of a variety of forms well known to those skilled in the reclosable packaging art, such as a vacuum conveyor for pulling the zipper strip 10 across the film material 32 and a knife for cutting the zipper strip 10, 30 from the continuous roll thereof 34.

Thermoplastic film material 32 is paid off from a continuous roll 36, as shown in FIG. 3, in increments equal to the length of the bags which will ultimately be formed from the film material 32. The longitudinal axis of the film material is parallel to the direction of travel of the film material. Each time the film material 32 comes to rest, the zipper strip 10, 30 is disposed on the film material 32 transverse to the longitudinal axis A with one of the profiles on top of the other profiles and the trailing flanges 26 projecting in the direction opposite the direction of motion of film material 32. The orientation of the profiles depends on which side of the zipper, if any, is adapted to be the opening side. As disclosed in U.S. Pat. No. 4,909,017, the zipper strip 10, 30 has a length approximately equal to half the width of the film material 32 and is disposed centrally thereon. Heater seal bars 36 straddle the length of zipper strip 10 and seal male and female profiles 12, 14 to each other and to film material 32 at the extremities of zipper strip 10, 30. In this manner a zipper strip having equal leading flanges, or no leading flanges at all, can be used for transverse zipper applications.

Figure 4:
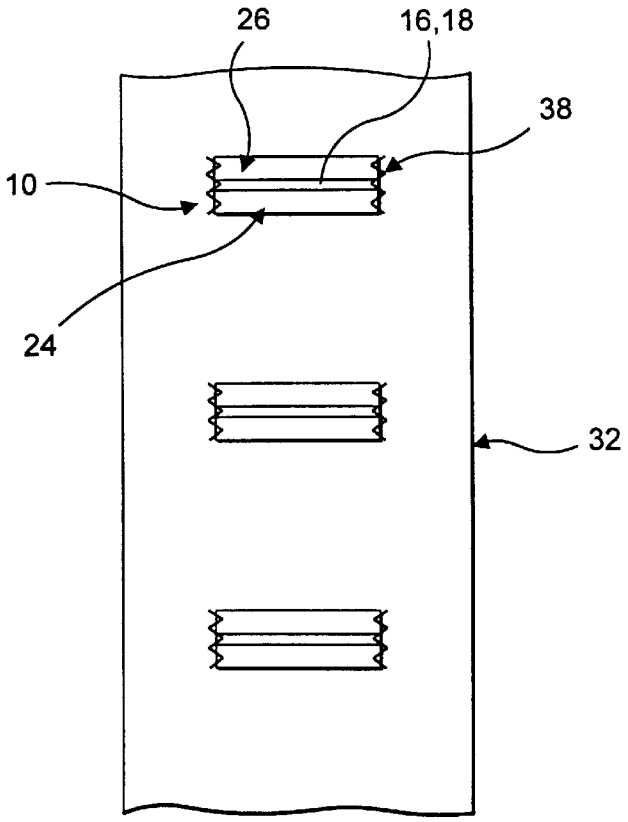
FIG. 4 is a plan view of thermoplastic film material with zipper strips having trailing and leading flanges attached transversely thereto wherein the zipper strips are continuously sealed to the film material across their entire widths.
Figure 5:
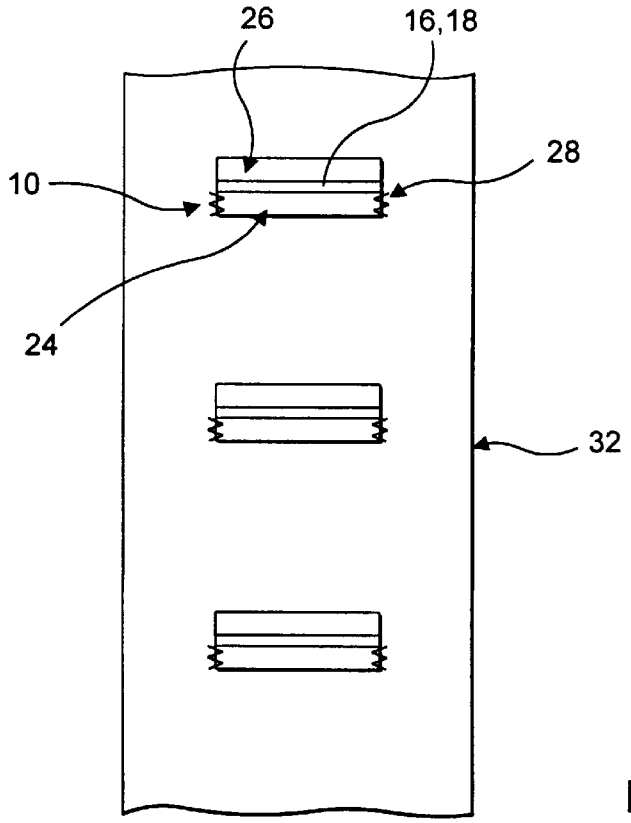
FIG. 5 is a plan view of thermoplastic film material with zipper strips having trailing and leading flanges attached transversely thereto wherein the zipper strips are continuously sealed to the film material across their leading flanges.

The seal may take on one of two forms, depending on the configuration of the heater bars 36. As shown in FIG. 4, the seal may be a continuous seal 38 across the width of the profiles 12, 14. In that case the webs 20, 22 are sealed to each other at their extremities and the male and female interlocking members 16, 18 are sealed to each other. Sealing the ends of the male and female interlocking members 16, 18 to each other has the added benefit of eliminating a step in the bag making process. In reclosable bags which utilize a reclosable interlocking zipper, the ends of the zipper are generally sealed together to ensure that the zipper will not separate completely when it is opened by the user. Accomplishing this task when sealing the zipper strip 10 to the film material 32 makes this step unnecessary, and is thus more efficient and cost effective. In the alternative, the seal 38 may be only across the leading flanges, as shown in FIG. 5.

Figure 6:
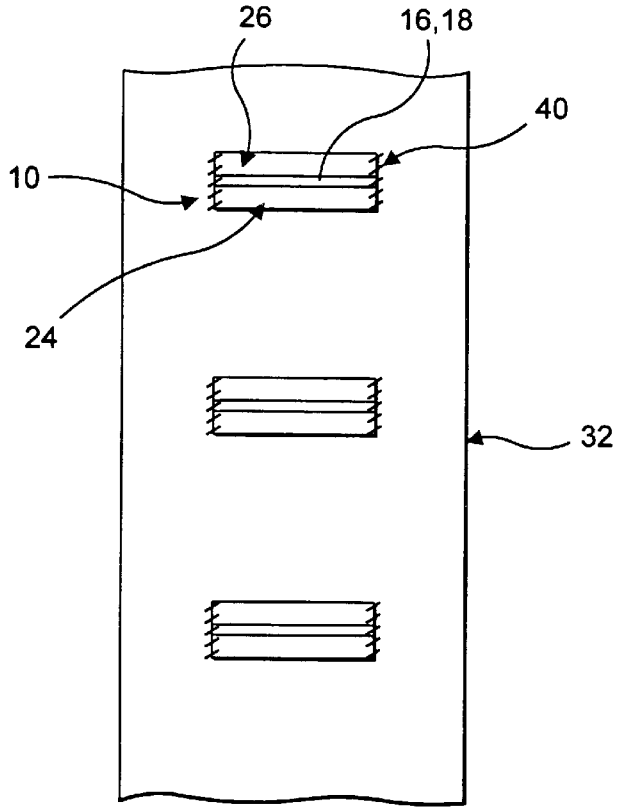
FIG. 6 is a plan view of thermoplastic film material with zipper strips having trailing and leading flanges attached transversely thereto wherein the zipper strips are spot sealed to the film material across their widths.
Figure 7:
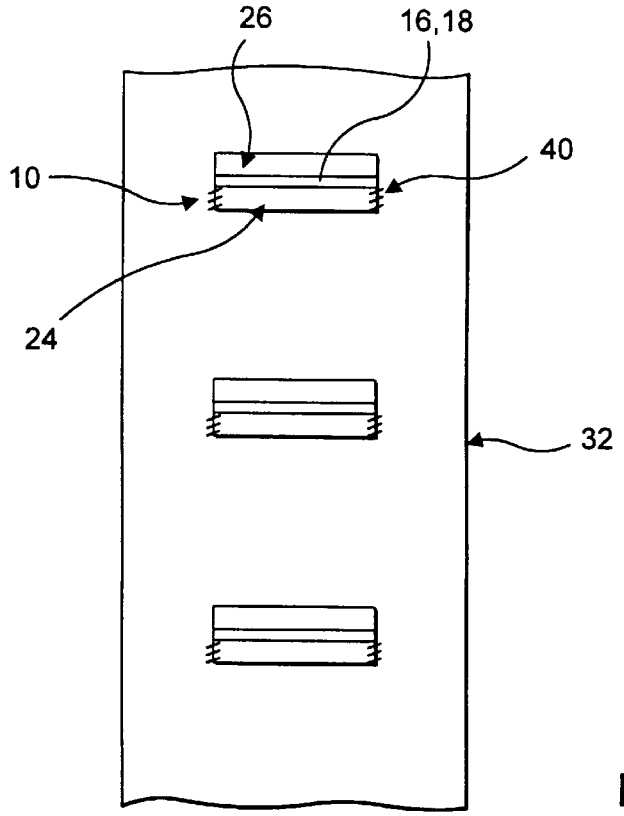
FIG. 7 is a plan view of thermoplastic film material with zipper strips having trailing and leading flanges attached transversely thereto wherein the zipper strips are spot sealed to the film material across their leading flanges.

Or, as shown in FIG. 6, the seal may take the form of spot seals 40 across the profiles 12, 14, in which case the male and female interlocking members 16, 18 may or may not be sealed to each other. The spot seals 40 may be placed across the width of the profiles or across the leading flanges, as shown in FIG. 7.

Figure 8:
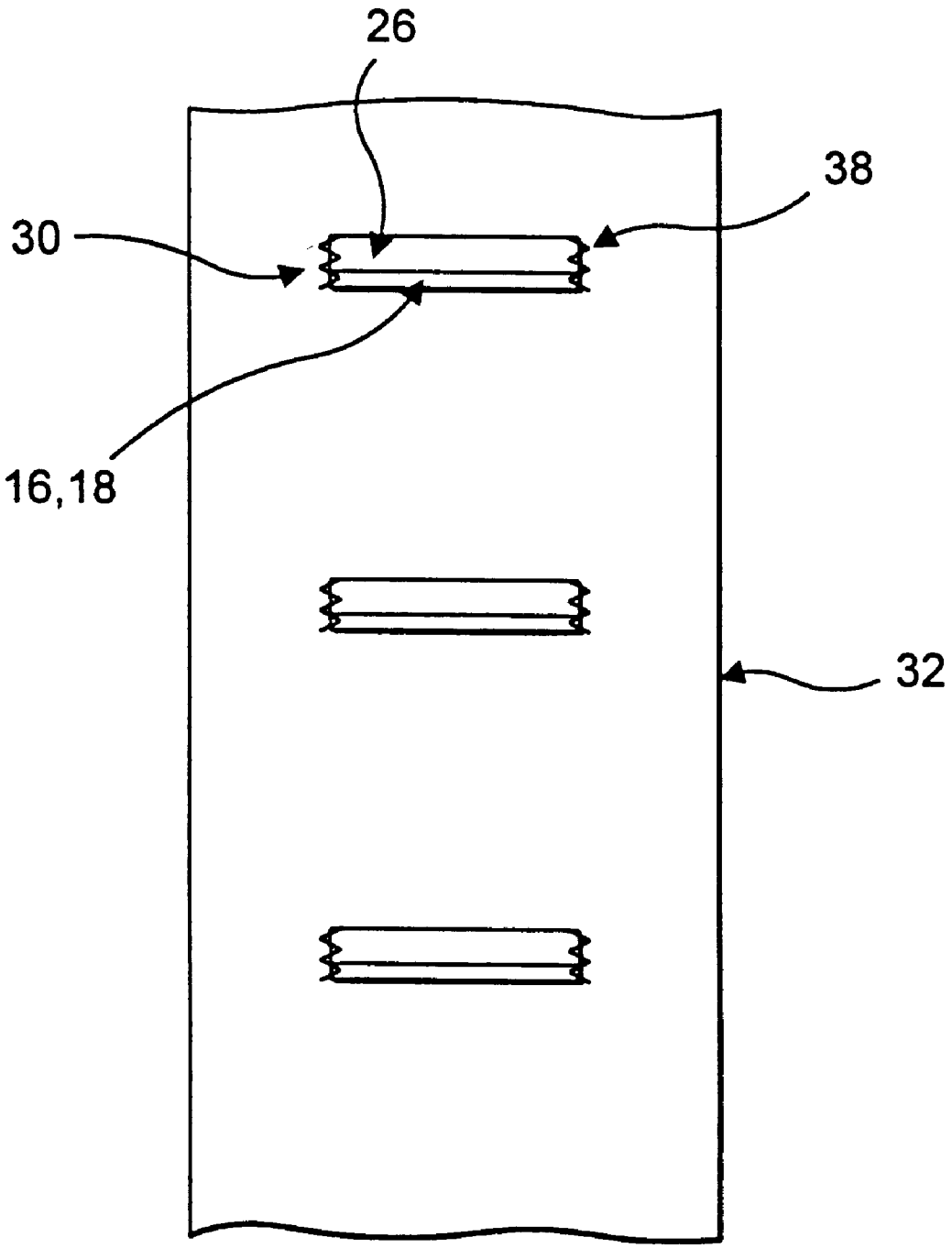
FIG. 8 is a plan view of thermoplastic film material with zipper strips having only trailing flanges attached transversely thereto wherein the zipper strips are continuously sealed to the film material across their entire widths.

In the embodiment where the profile of FIG. 2 is used, a continuous seal 38 is placed across the width of the zipper strip 30, as shown in FIG. 8. Although a spot seal may be used, a spot seal is not desirable in this situation because the leading interlocking members 16, 18 need to be sealed directly to the film, and this may be difficult to achieve with a spot seal. The advantage of the zipper strip 30 of FIG. 2 over the zipper strip 10 of FIG. 1 is clear. The zipper strip 30 of FIG. 2 uses less material than the zipper strip 10 of FIG. 1, making manufacture of the zipper strip more cost effective.

The transverse zipper-equipped material may either be re-rolled for later use on a FFS machine, or may be fed directly into a FFS machine to make reclosable bags.

Figure 9:
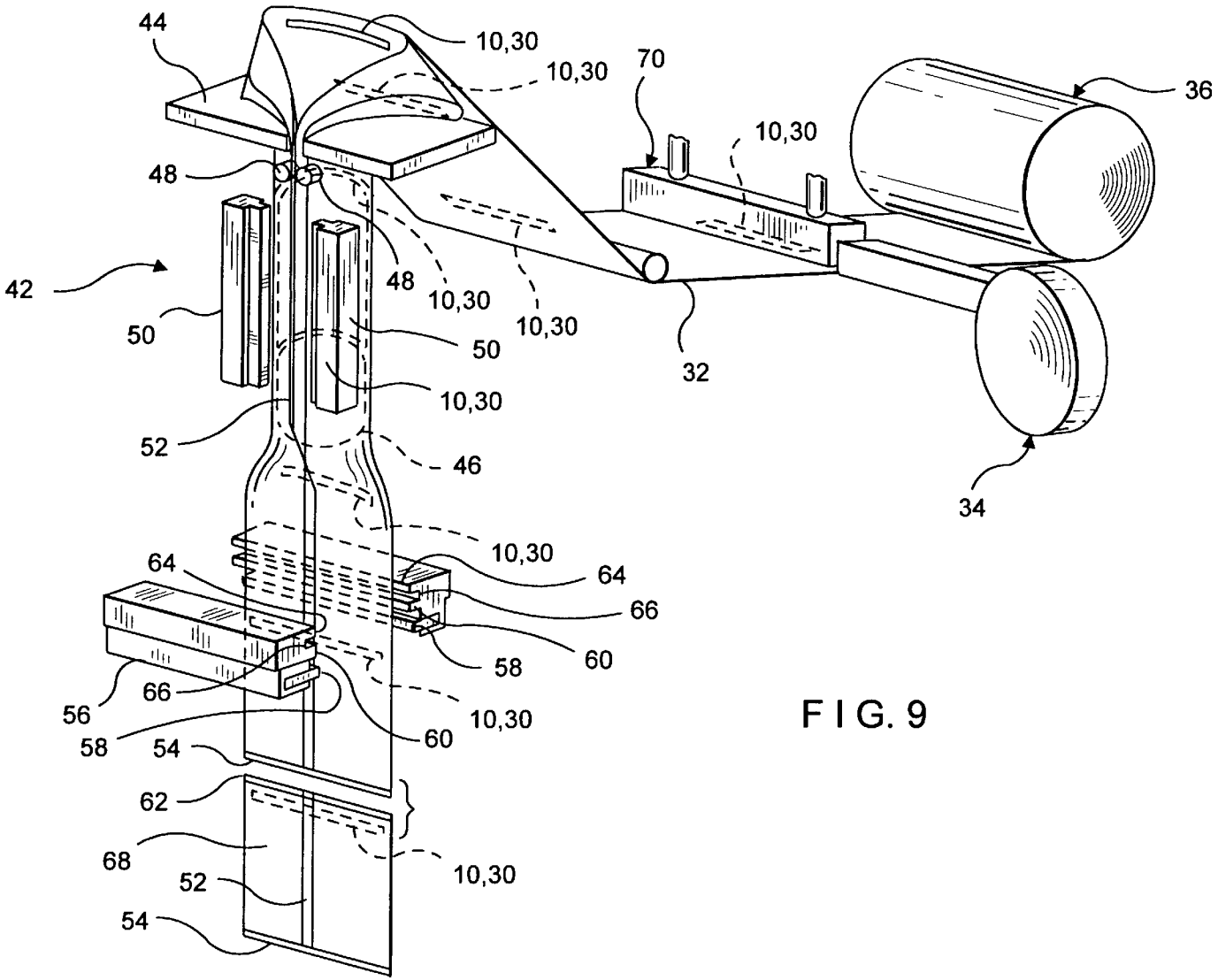
FIG. 9 is a perspective view of a FFS machine which can be used to make reclosable bags from the transverse zipper-equipped thermoplastic film material.

FIG. 9 shows how the thermoplastic film material 32 with the transverse zipper strips 10, 30 attached thereto at bag length intervals can be made into reclosable bags on a FFS machine 42. The thermoplastic film 32 is fed downwardly over collar 44 and folded around filling tube 46. The edges of the film are brought together and pressed together by a pair of rollers 48. The edges are then welded together by heater bars 50 to form a longitudinal back seam 52. Contents may then dropped through the tube 46 into the open bag which has a lower seam 54. As discussed below, the lower seam 54 was made when the preceding bag was completed.

After introduction of the contents, the top of the bag is completed by the action of cross seal jaws 56, which perform three simultaneous functions. First, heater bars 58 seal the trailing flanges 26 of the zipper strip 10, 30 to the front and back inner surfaces of the bag without sealing the trailing flanges 26 to each other. This is possible through the use of the heat activated adhesive 28 on the outside of the trailing flanges 26. Second, heater bars 60 seal the top of the bag so as to form a pilfer evident seal 62, while heater bars 64 make the lower seam 54 for the next succeeding bag. And third, knife 66 cuts the bottom completed bag 68 from the tube. The completed bag has a pilfer evident seal 62, a transverse zipper 10, 30, a lower seam 54 and a back seam 52. Thus, this method is similar to that of U.S. Pat. No. 4,909,017, except that in that patent only one of the profiles is sealed to the flat thermoplastic film material.

Modifications to the above would be obvious to those of ordinary skill in the art, but would not bring the invention so modified beyond the scope of the appended claims.

We claim:

1. A method for attaching a zipper strip transversely to thermoplastic film material for use in the production of plastic bags or packages to be made on a form-fill-seal machine from said thermoplastic film material, said thermoplastic film material having a longitudinal axis and being advanced along said axis in amounts equal in length to that of the bags or packages being manufactured, a length of zipper strip being attached each time said thermoplastic film material is brought to rest, said method comprising the steps of:

providing a length of zipper strip having male and female interlocking profiles; said male profile including a male interlocking member and an integral web on a lateral side thereof; said female profile having a female interlocking member and an integral web on a lateral side thereof;

disposing said length of zipper strip upon said thermoplastic film material transversely to said longitudinal axis with one of said profiles positioned above the other of said profiles; and sealing said male and female profiles to each other and to said thermoplastic film material at the extremities of said length of zipper strip.

2. A method according to claim 1 wherein said sealing is continuous across said zipper strip width.

3. A method according to claim 1 wherein said profiles are spot sealed across said zipper strip width.

4. A method according to claim 1 wherein:

said male profile integral web defines a trailing flange;

said female profile integral web defines a trailing flange; and said length of zipper strip is disposed upon said thermoplastic film material with said trailing flanges directed opposite to the direction of motion of said thermoplastic film material.

5. A method to according to claim 4:

wherein each of said male and female profiles further includes a second integral web on the lateral side thereof opposite to said trailing flange, each of said second integral webs defining a leading flange; and wherein said sealing is continuous across said zipper strip width.

6. A method to according to claim 4:

wherein each of said male and female profiles further includes a second integral web on the lateral side thereof opposite to said trailing flange, each of said second integral webs defining a leading flange; and wherein said profiles are spot sealed across said zipper strip width.

7. A method to according to claim 4:

wherein each of said male and female profiles further includes second integral web on the lateral side thereof opposite to said trailing flange, each of said second integral webs defining a leading flange; and wherein said sealing is continuous across said leading flanges.

8. A method to according to claim 4:

wherein each of said male and female profiles further includes second integral web on the lateral side thereof opposite to said trailing flange, each of said second integral webs defining a leading flange; and wherein said profiles are spot sealed across said leading flanges.

9. A method of making reclosable packages comprising the steps of:

providing thermoplastic film material having a longitudinal axis and advancing said thermoplastic film material along said axis in amounts equal in length to that of said packages;

providing a length of zipper strip having male and female interlocking profiles; said male profile including a male interlocking member and an integral web on a lateral side thereof defining a trailing flange; said female profile including a female interlocking member and an integral web on a lateral side thereof defining a trailing flange;

disposing said length of zipper strip upon said film material transversely to said longitudinal axis with one of said profiles positioned above the other of said profiles and said trailing flanges directed opposite to the direction of motion of said thermoplastic film material each time said film material is brought to rest;

sealing said male and female profiles to each other and to said thermoplastic film material at the extremities of said length of zipper strip;

folding said thermoplastic film material so as to bring the longitudinal edges together;

sealing the longitudinal edges to form a package having front and back walls;

sealing said zipper trailing flanges to the inner surfaces of said package walls without sealing said trailing flanges to each other;

cross-sealing said package walls to each other above said zipper strip to form the top of that package and the bottom end of a succeeding package; and cutting said thermoplastic film material between said cross-seals to remove a completed package from said thermoplastic the film.

* * * * *